US010814200B2

(12) United States Patent
Scott

(10) Patent No.: US 10,814,200 B2
(45) Date of Patent: Oct. 27, 2020

(54) SPORTS HITTING TRAINING SYSTEM FOR LIGHTWEIGHT BALLS

(71) Applicant: XL GROUP, LLC, Seattle, WA (US)

(72) Inventor: Terence Scott, Laurel, MD (US)

(73) Assignee: XLP GROUP, LLC, Seattle, WA (US)

( * ) Notice: Subject to any disclaimer, the term of this patent is extended or adjusted under 35 U.S.C. 154(b) by 0 days.

(21) Appl. No.: 16/287,675

(22) Filed: Feb. 27, 2019

(65) Prior Publication Data

US 2019/0358512 A1 Nov. 28, 2019

Related U.S. Application Data

(63) Continuation-in-part of application No. 16/108,832, filed on Aug. 22, 2018.

(60) Provisional application No. 62/676,797, filed on May 25, 2018.

(51) Int. Cl.

| | |
|---|---|
| ***A63B 69/00*** | (2006.01) |
| ***A63B 69/36*** | (2006.01) |
| ***A63B 102/02*** | (2015.01) |
| ***A63B 102/18*** | (2015.01) |
| ***A63B 102/32*** | (2015.01) |
| ***A63B 69/38*** | (2006.01) |

(52) U.S. Cl.

CPC ..... *A63B 69/0091* (2013.01); *A63B 69/0002* (2013.01); *A63B 69/002* (2013.01); *A63B 69/36* (2013.01); *A63B 69/38* (2013.01); *A63B 2069/0008* (2013.01); *A63B 2102/02* (2015.10); *A63B 2102/18* (2015.10); *A63B 2102/182* (2015.10); *A63B 2102/32* (2015.10); *A63B 2243/0025* (2013.01)

(58) Field of Classification Search

CPC ..... A63B 69/0002; A63B 69/0073; A63B 69/0091; A63B 2069/0075; A63B 2069/0008

USPC ..... 473/417, 423–425, 427, 429, 430

See application file for complete search history.

(56) References Cited

U.S. PATENT DOCUMENTS 3,183,000 A * 5/1965 Dix ..... A63B 69/0075 473/417

3,350,097 A 10/1967 Chevrette et al.

(Continued)

FOREIGN PATENT DOCUMENTS

WO 2009062272 A1 5/2009

WO 2018000030 A1 1/2018

*Primary Examiner* — Jeffrey S Vanderveen

(74) *Attorney, Agent, or Firm* — Innovation Capital Law Group, LLP; Vic Lin

(57) ABSTRACT

A hitting system for sports training includes a ball attached to a flexible mast. The flexible mast may be mounted to a base with more than five sidewalls, which inhibits movement of the system in any one direction after the ball is struck by the user. The mast may project upward from the base. Some embodiments include a weighted basket, which may be filled for example with a plurality of the same type of ball mounted to the flexible mast. Some embodiments may be configured for training with lightweight balls, for example pickle balls. The mast may include a securing mechanism which attaches around one of the pre-existing holes of the ball's shell. In some embodiments, the mast may be modular including a mechanism to detach from and reattach to the basket at the user's will. When detached, the mast becomes a hand-held hitting system.

9 Claims, 11 Drawing Sheets

(56) References Cited

U.S. PATENT DOCUMENTS 3,550,938 A * 12/1970 Cunningham ..... A63B 69/40 473/429
3,858,879 A * 1/1975 Candor ..... A63B 69/0075 473/417
3,891,221 A 6/1975 Gordon
4,854,587 A * 8/1989 Groves ..... A63B 69/0002 473/417
4,903,966 A * 2/1990 Liao ..... A63B 69/0091 473/423
4,938,478 A * 7/1990 Lay ..... A63B 69/0091 473/423
D312,665 S 12/1990 Fuller et al.
5,035,424 A * 7/1991 Liao ..... A63B 69/0091 473/139
5,381,895 A 1/1995 Thomsen
D434,453 S 11/2000 Kenyon
6,296,581 B1 10/2001 Sever
6,454,670 B1 * 9/2002 Beers ..... A63B 69/0091 473/422
D509,551 S 9/2005 Reynolds
D793,498 S 8/2017 Manus
D872,815 S 1/2020 Parsons
2006/0199672 A1 * 9/2006 Flanigan ..... A63B 47/007 473/417
2007/0167261 A1 * 7/2007 Lortscher ..... A63B 69/0002 473/417
2008/0064534 A1 3/2008 Lortscher
2009/0149279 A1 * 6/2009 Fischer ..... A63B 69/0002 473/417
2010/0288908 A1 11/2010 McGraw
2011/0077109 A1 3/2011 Crowley
2012/0298537 A1 11/2012 Calderon
2014/0121040 A1 5/2014 Cappello et al.
2014/0243116 A1 * 8/2014 Durham ..... A63B 69/0075 473/417
2016/0114237 A1 4/2016 Garcia, Jr.
2017/0340940 A1 11/2017 Danielson et al.
2017/0354855 A1 12/2017 Cullen et al.
2019/0184258 A1 6/2019 Kim

* cited by examiner

SPORTS HITTING TRAINING SYSTEM FOR LIGHTWEIGHT BALLS

RELATED APPLICATION

This application claims benefit under 35 U.S.C. § 119(e) of U.S. Provisional Application having Ser. No. 62/676,797 filed May 25, 2018, and U.S. Non-Provisional application Ser. No. 16/108,832 filed Aug. 22, 2018 which are hereby incorporated by reference herein in its entirety.

BACKGROUND OF THE INVENTION

Field of the Invention

This invention generally relates to sporting equipment, and more particularly, to a sports hitting training system.

Description of Prior Art and Related Information

Many who are engaged in sports train their form to improve performance. To improve form, many turn to equipment that replicates a particular sports movement. For example, in many sports, hitting a ball is a common part of the sport. However, hitting a standalone ball usually means the ball is launched far away from the person training.

There exist a number of training tools that prevent a ball-type object from travelling far from the person. For example, there are baseball hitting sticks of hard rubber that include a one-piece mold protuberance on the end of a stick and paint seams on the protuberance to resemble a baseball. Another person needs to hold the opposite end of the stick. The person holding the stick can easily fatigue and the level of the "ball" becomes inconsistent.

Other training aids in general may tether a rope to a ball. The distance the ball is hit is limited by the length of the rope. While effective at preventing one to have to go far and retrieve the ball, the ball generally needs to be reeled in and reset into position. This can lead to a lot of wasted time in a training session; especially where the user wants to practice a high frequency of repetitions.

As can be seen, there is a need to improve on the efficiency provided by current sports hitting training systems.

BRIEF SUMMARY OF THE INVENTION

In one aspect, a hitting training system for lightweight ball-based activities is disclosed. The system comprises a base; a flexible mast projecting upward from the base; and a ball weighing one ounce or less, affixed to an end of the mast, distal from the base, wherein hitting the ball from a default position of the mast bends the flexible mast and wherein the mast is configured to return to the default position after the ball is hit.

In another aspect, a hitting training system for lightweight ball-based activities is disclosed. The system comprises a polygonal base including five or more sidewalls; a basket positioned over the polygonal base, the basket configured for receipt of a plurality of hollow, lightweight balls; a suspension system coupled to the basket, the suspension system including a coupler proximate a center of the suspension system; a flexible mast attachable to the coupler in the suspension system, the mast projecting upward from the basket; and a selected hollow, lightweight ball affixed to an end of the mast, distal from the basket, wherein hitting the selected ball from a default vertical position of the mast bends the flexible mast and wherein the mast is configured to return to the default vertical position after the selected ball is hit.

In yet another aspect, a hitting training system for lightweight ball-based activities is disclosed. The system comprises a flexible pole; a handle coupled to a first end of the flexible pole; a hollow, lightweight ball including a shell with perforations, including a pair of holes through which the flexible pole is passed through, wherein the ball is positioned on a second end of the pole, the second end being opposite the first end of the pole and wherein the perforations are positioned around the shell; and a cap on the second end of the pole preventing the ball from sliding off the pole.

The invention and its various embodiments can now be better understood by turning to the following detailed description wherein illustrated embodiments are described. It is to be expressly understood that the illustrated embodiments are set forth as examples and not by way of limitations on the invention as ultimately defined in the claims.

DETAILED DESCRIPTION OF THE PREFERRED EMBODIMENTS

The detailed description set forth below is intended as a description of various configurations of the subject technology and is not intended to represent the only configurations in which the subject technology may be practiced. The appended drawings are incorporated herein and constitute a part of the detailed description. The detailed description includes specific details for the purpose of providing a thorough understanding of the subject technology. However, it will be apparent to those skilled in the art that the subject technology may be practiced without these specific details. Like or similar components are labeled with identical element numbers for ease of understanding.

Figure 1:
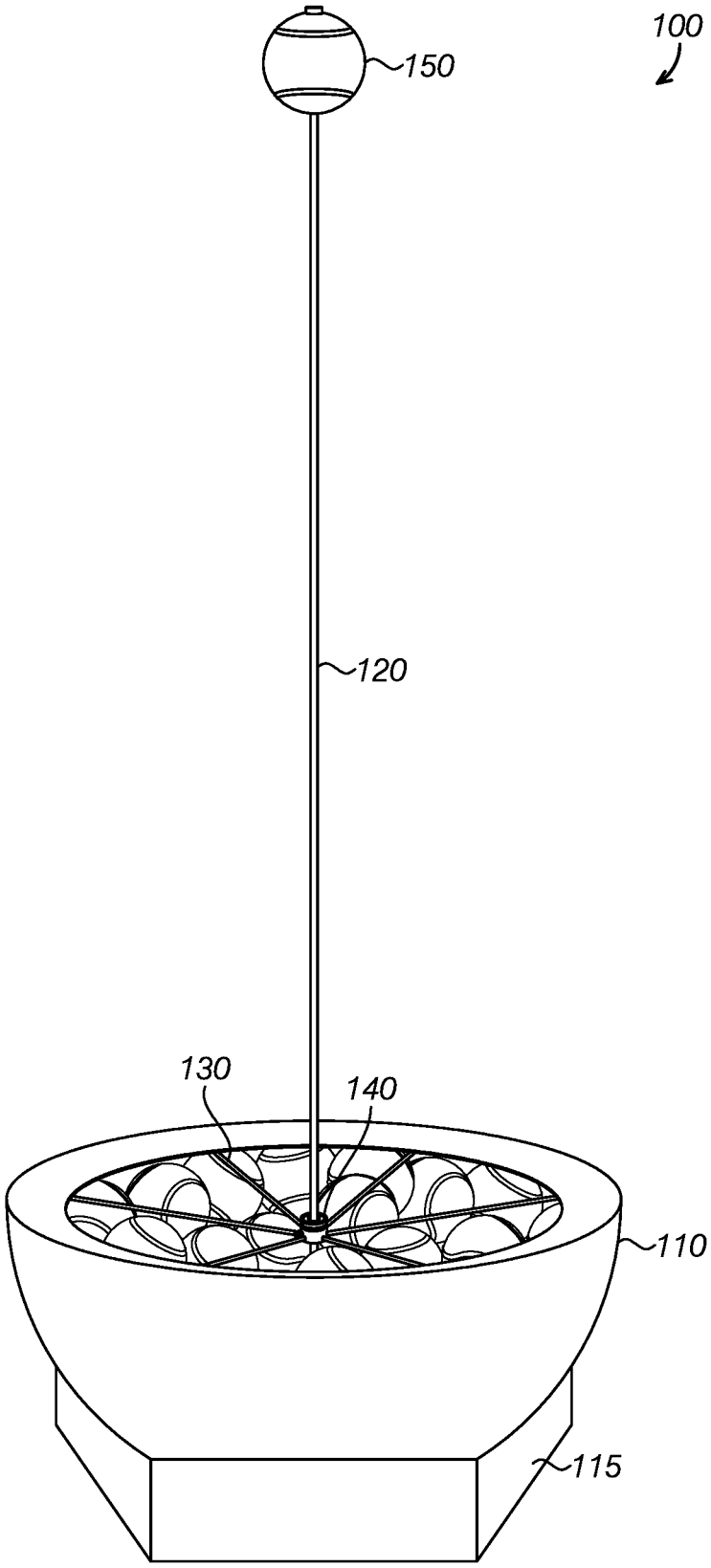
FIG. 1 is a side view of a hitting training system in accordance with an exemplary embodiment.

Referring now to FIG. 1, a hitting training system 100 (sometimes referred to simply as the "system") for sports is shown according to an exemplary embodiment. In general, the system 100 includes a base 115, a flexible mast 120, and a sports-based ball 150 (referred to generally as a "ball"). In some embodiments, a basket 110 may be positioned over the base 115 (or may be integrated into a one-piece unit with base 115).

The basket 110 and/or the base 115 may be weighted. For example, the basket 110 may include a hollow interior for carrying a multitude (plurality) of the type of ball being trained with. In the illustration shown, the system 100 is configured for training tennis swings and the ball 150 is a modified tennis ball. The basket 110 may be filled with other tennis balls (which may be unmodified) adding weight and stability to the system 100. As will be appreciated, the basket 100 simultaneously provides a convenient device for carrying tennis balls to a practice site in addition to providing a support for the flexible mast 120.

Figure 4A:
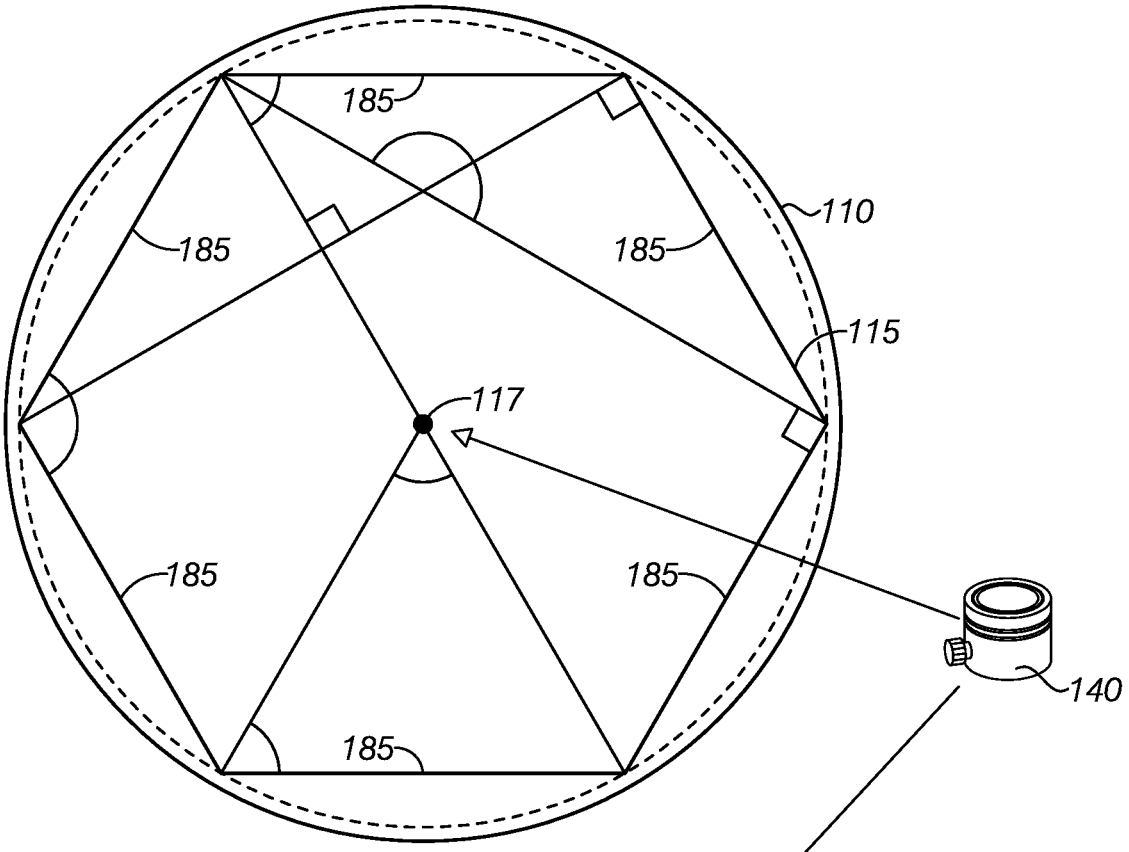
FIG. 4A is a top view of the basket of FIG. 3A depicting angles for a polygonal base in accordance with an exemplary embodiment.
Figure 4B:
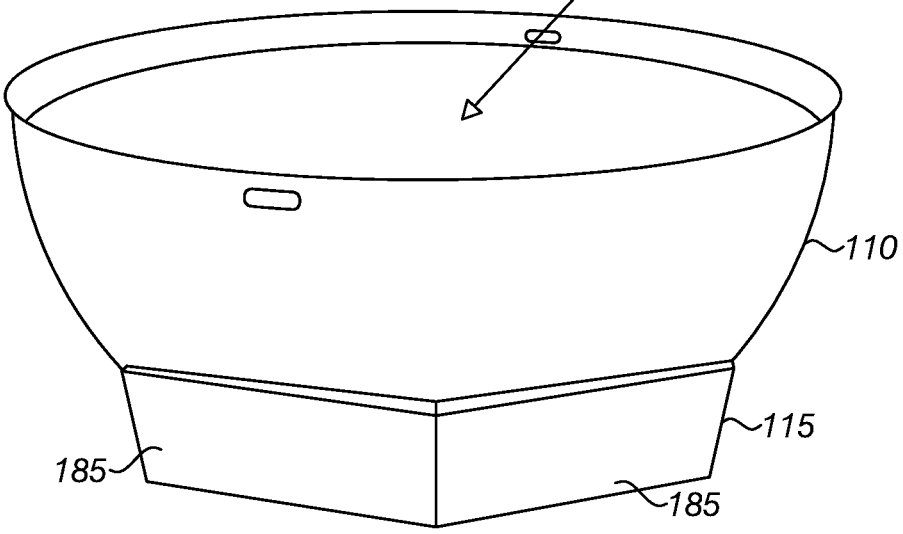
FIG. 4B is the perspective side view of the basket of FIG. 3A depicting receipt of a collar in the center of the basket relative to the angles of FIG. 4A.

In some embodiments, the basket 110 may include a substantially open-ended top. Wires or spokes 130 projecting inward from a periphery of the basket 110 top may be arranged into a suspension system meeting at a central hub 140 (such as a collar with a set screw seen in more detail in FIGS. 4A and 4B). One end of the flexible mast 120 (proximal end) may be set into position in the central hub 140 and may project upwardly therefrom. The ball 150 may be positioned on the opposite end of the flexible mast 120 (the distal end). The flexible mast 120 may be plastic, rubber, or some combination of plastic or rubber sheathing a metal core.

In operation, as the ball 150 is struck from its default position (vertical/perpendicular from the ground), the flexible mast 120 will bend in the direction of force applied until the bend force limit is reached, at which point the flexible mast 120 snaps back toward its default position bringing the ball 150 back with it. As will be appreciated, since a real tennis ball 150 is used, damage to the fragile strings of a tennis racquet are avoided which could occur using for example, a hard plastic or rubber protuberance.

Figure 2A:
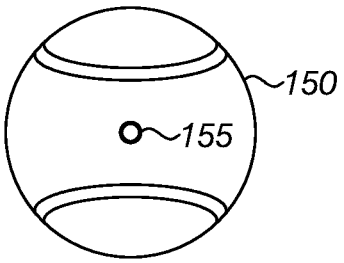
FIG. 2A is a top view of an exemplary ball used in the system of FIG. 1.
Figure 2B:
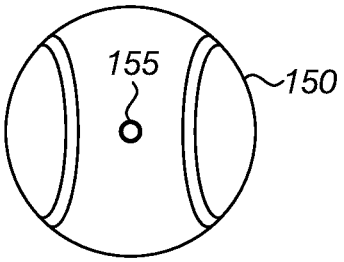
FIG. 2B is a bottom view of the ball of FIG. 2B.
Figure 2C:
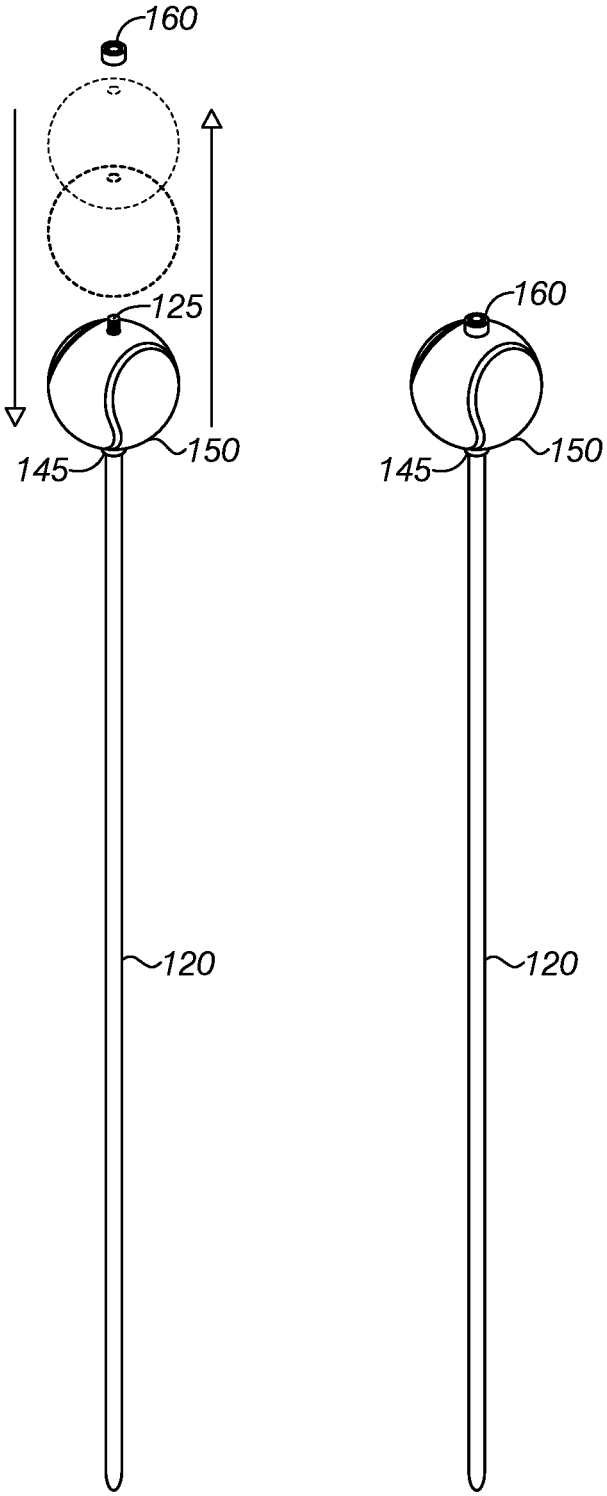
FIG. 2C includes juxtaposed partial side views of a ball attached to and exploded from a mast used in the system of FIG. 1, in accordance with an exemplary embodiment.
Figure 3A:
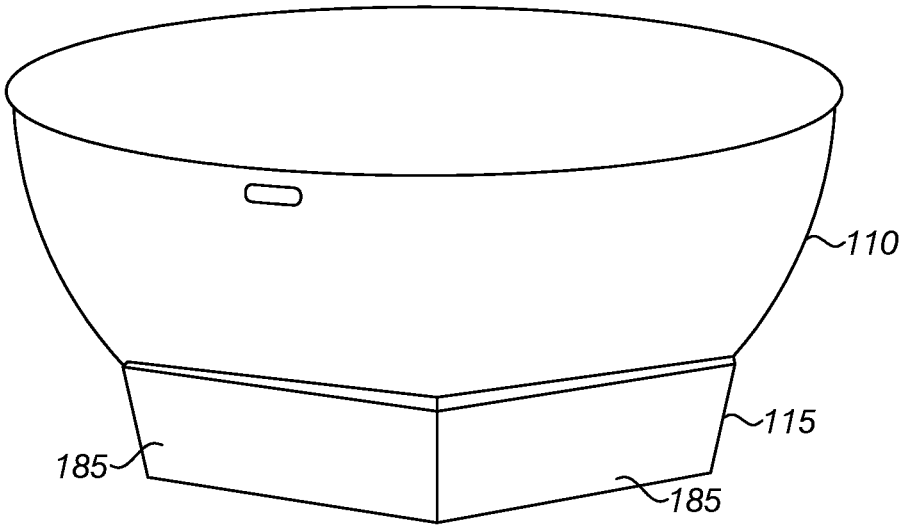
FIG. 3A is a perspective side view of a basket from the system of FIG. 1 in accordance with an exemplary embodiment.
Figure 3B:
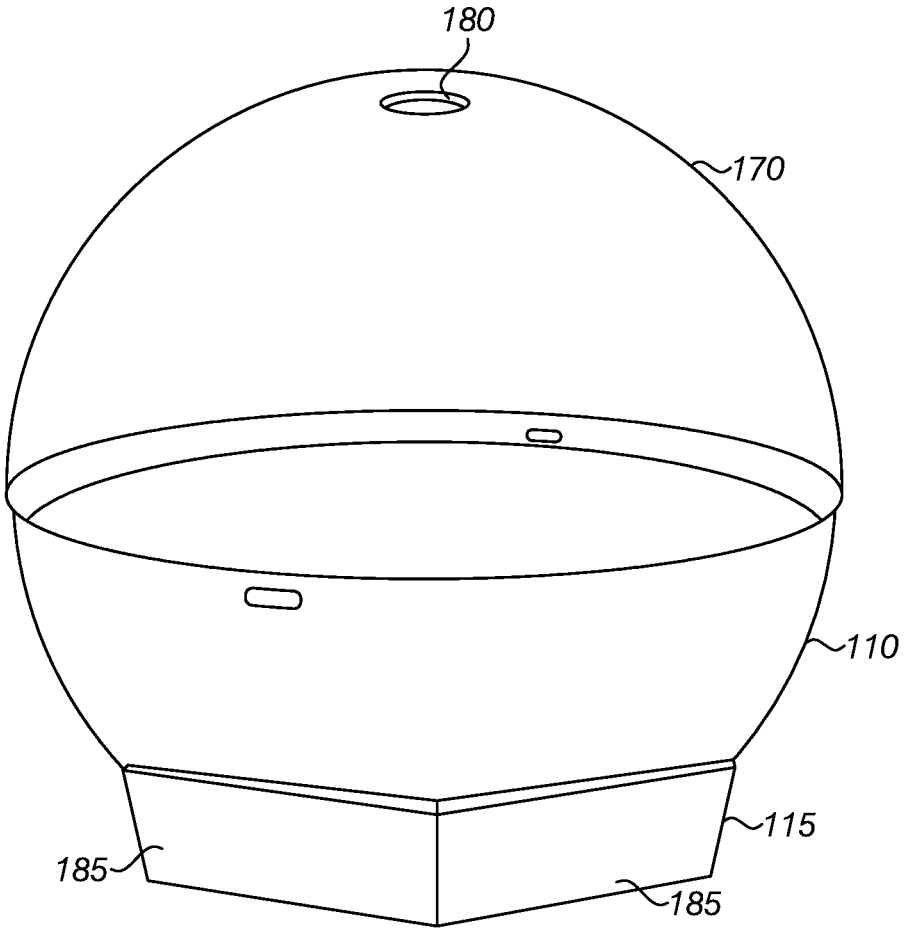
FIG. 3B is a perspective side view of the basket of FIG. 3A with a cover in place in accordance with an exemplary embodiment.

Referring now to FIGS. 2A, 2B, and 2C, details of the ball 150 mounted to the flexible mast 120 are shown according to an exemplary embodiment. In some embodiments, the ball 150 may be pierced on opposite sides of the ball with through holes 155. The distal end of the flexible mast 120 (the end opposite the base 115) may include a threaded boss 125. Some embodiments may include a seat 145 intermediate the ends of the mast 120. The seat 145 may be for example a washer that is stopped by an expanding circumference of the mast 120 or may be affixed to the mast 120. In an exemplary embodiment, the seat 145 may be proximate the distal end. For example, diameter of the ball 150 may be the distance used to position the seat 145 from the distal end. The flexible mast 120 may be passed through the through holes 155 until the ball 150 abuts the seat 145. On the opposite side of the ball 150, a cap 160 may be threaded on (or press fit depending on the embodiment) to the end 125 to secure the ball 150 into place against the seat 145.

In some embodiments, the suspension system, flexible mast 120 and ball 150 may be removable from the basket 110 so that the basket 110 may be used in a conventional manner as a device to carry balls. As will be appreciated, some embodiments may retrofit elements of the system 100 to a pre-existing basket 110, thus providing the benefits disclosed without needing to purchase an entirely new system.

Referring now to FIGS. 3A, 3B, 4A, 4B and 5, details of the basket 110 and base 115 are shown according to exemplary embodiments. In some embodiments, the basket 110 and/or base 115 may include a cover 170. In the embodiment shown, the cover 170 is spherical in theme with the concept of a round ball. The cover 170 may include an opening 180 aligned with the center 117 (FIG. 4A) of the base 115. It will be understood that the flexible mast 120 may pass through the opening 180 if the user wishes to have the cover 170 in place during use.

Figure 5:
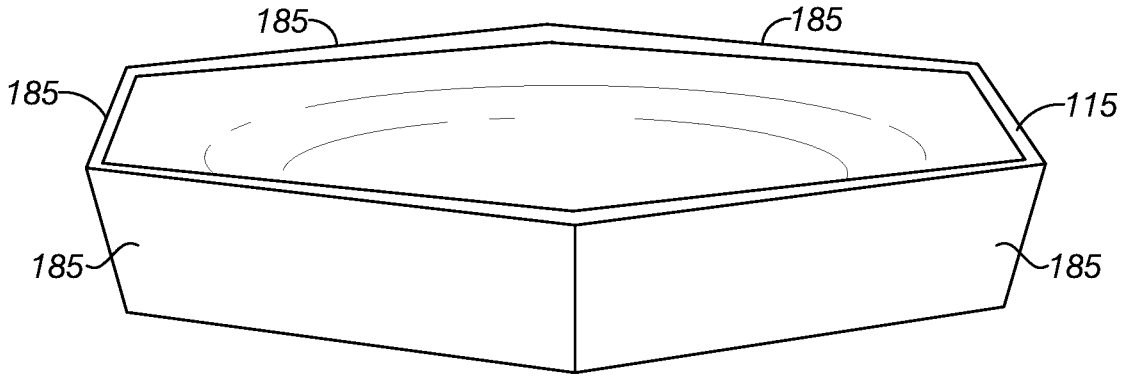
FIG. 5 is a perspective top view of a polygonal base used in the basket of FIG. 3A in accordance with an exemplary embodiment.

In an exemplary embodiment, the base 115 includes five or more sidewalls 185. As will be appreciated, including five or more sidewalls 185 resists the various forces created by the ball 150 (FIG. 1) being struck. The angles shown represent the vectors resisting an arbitrary direction toward which the ball is struck. As may be appreciated, round bases or rectangular bases may in some embodiments, suffer in that the base of such designs may travel a short distance in the direction of the ball being struck. This can be inconvenient. However, embodiments with five or more sidewalls 185 create a braking force to keep the system 100 in place. FIG. 5 shows a top perspective view of the base 115 with six sidewalls 185 without a basket 110 attached.

Figure 6:
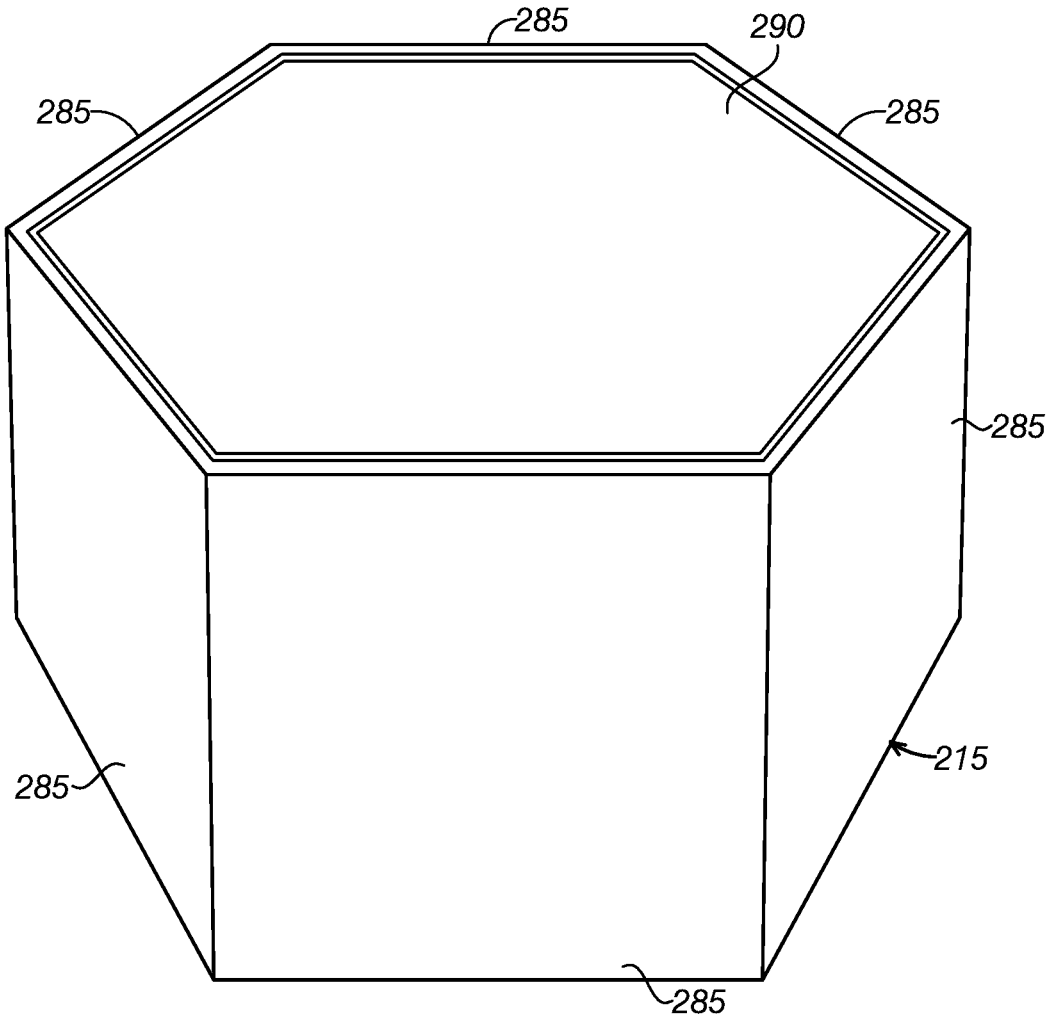
FIG. 6 is a perspective top view of a polygonal basket base in accordance with an exemplary embodiment.
Figure 7A:
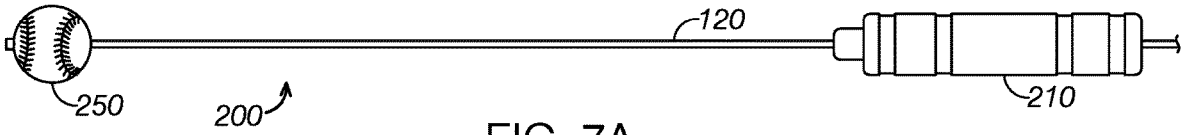
FIG. 7A is a partial side view of a hitting training system in accordance with another exemplary embodiment.
Figure 7B:
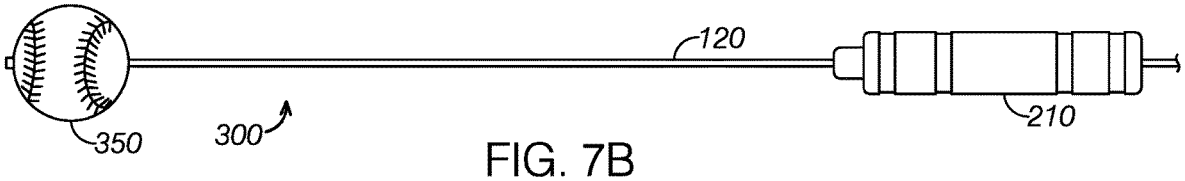
FIG. 7B is a partial side view of a hitting training system in accordance with yet another exemplary embodiment.
Figure 7C:
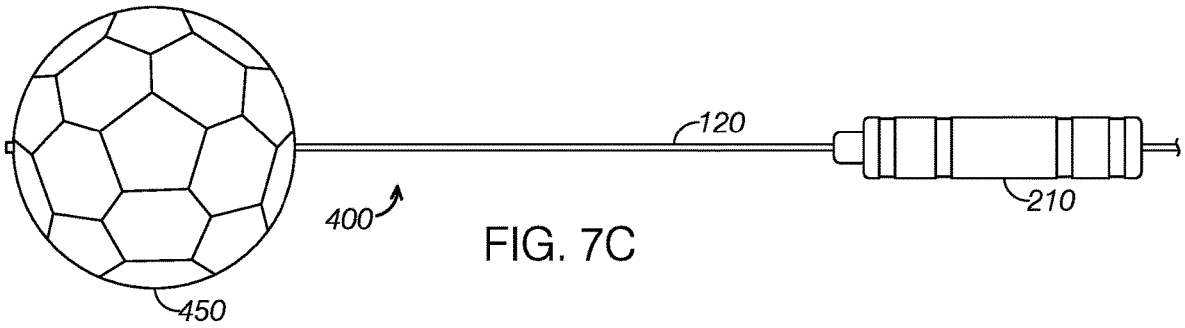
FIG. 7C is a partial side view of a hitting training system in accordance with yet another exemplary embodiment.
Figure 7D:
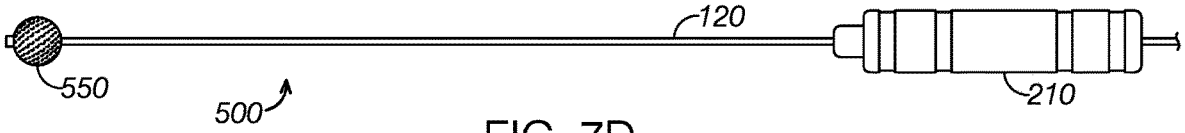
FIG. 7D is a partial side view of a hitting training system in accordance with yet another exemplary embodiment.

Referring to FIG. 6, a base 215 is shown according to another exemplary embodiment. The base 215 is similar to the base 115, except that the base 215 may be a standalone base and basket in one. The base 215 includes five or more sidewalls 285. It will be understood that the interior may be substantially hollow to carry for example, balls. The interior is obstructed from view by a cover 290 which has the same shape formed by the sidewalls 285. During use as a hitting system, the cover 290 may be removed and a suspension system similar to the one shown in FIG. 1 may be attached.

Referring now to FIGS. 7A, 7B, 7C, and 7D, various hitting systems (200, 300, 400, and 500) are shown according to exemplary embodiments using different sports balls. In general, each system (200, 300, 400, and 500) may include the flexible mast 120 (described above) attached to a handle 210. Each system (200, 300, 400, and 500) may include respectively its own ball (baseball 250 for batting; softball 350 for batting; soccer ball 450 for striking (kicking); and golf ball 550 for driving) for its respective sport being trained. As can be appreciated, aspects of the embodiments can be used for striking a ball with other equipment (such as a bat, racquet, or golf club) and for striking a ball without equipment (for example, kicking the soccer ball). In some embodiments, the system (200, 300, 400, and 500) may be handheld by another user holding the handle 210.

Figure 8A:
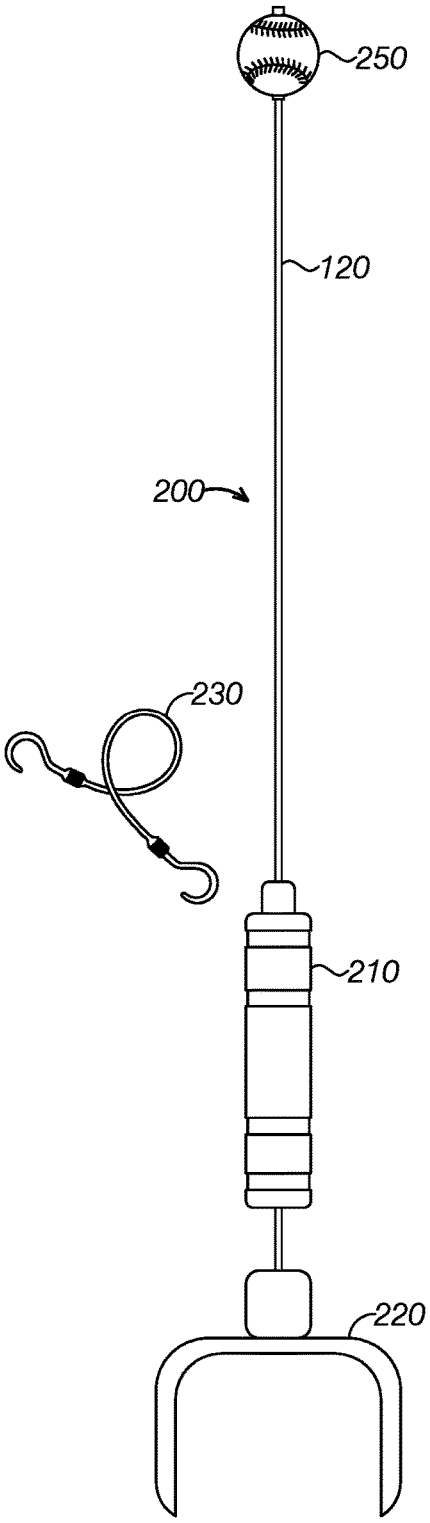
FIG. 8A is a side view of the hitting training system of FIG. 7A with a mounting system in accordance with another exemplary embodiment.
Figure 8B:
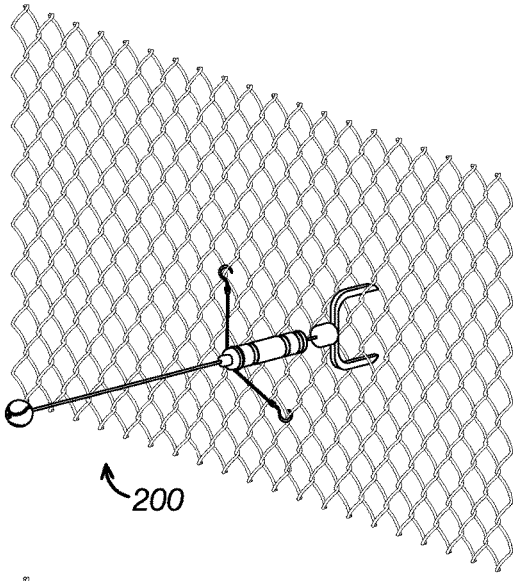
FIG. 8B is a perspective top view of the system of FIG. 8A mounted to a chain link fence in accordance with an exemplary embodiment.
Figure 8C:
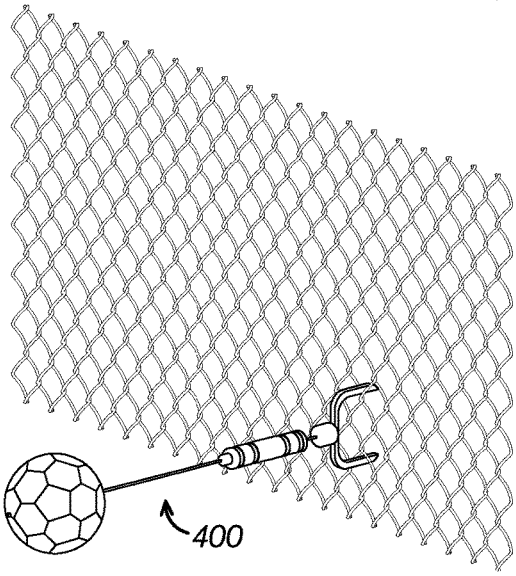
FIG. 8C is a perspective top view of the system of FIG. 7C mounted to a chain link fence in accordance with an exemplary embodiment.
Figure 8D:
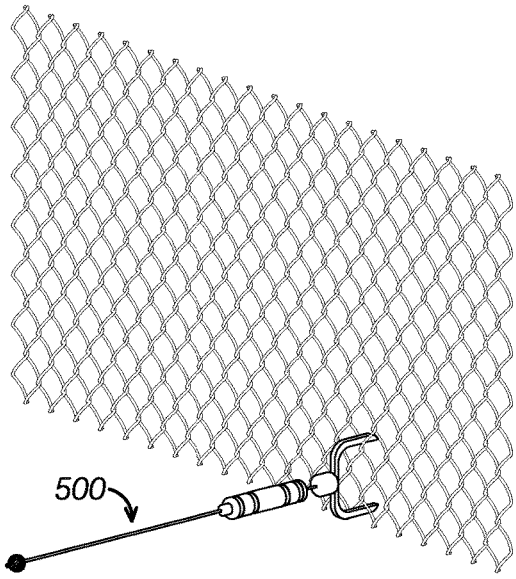
FIG. 8D is a perspective top view of the system of FIG. 7D mounted to a chain link fence in accordance with an exemplary embodiment.

Referring now to FIGS. 8A, 8B, 8C, and 8D, in other embodiments, the systems (200, 400, and 500) may be used by a single user (in other words, without another person holding it), with the help of additional features. It will be understood that the system 300 for softball may also be contemplated under the following description but is omitted from these figures for sake of illustration and its redundancy with the use of system 200 for baseball. Using system 200 as an example representative of the other system (300, 400, and 500) as shown in FIG. 8A, the system 200 may include in addition to the features described in FIG. 7A, a clamp 220 (or other mounting fixture). Some embodiments may also include a tension system 230 (such as a bungee cord with hooks). Referring to FIGS. 8B, 8C, and 8D, each respective system 200, 400, and 500 may be attached to a freestanding structure such as a chain link fence by securing the clamp 220 through openings in the fence or to the fence's structure. The system 200, 300, or 400 may project out from the fence so that the ball 250, 450, or 550 and mast 120 may be parallel to the ground surface supporting the fence. In operation, as the ball (250, 450, 550) is struck, the flexible mast 120 may bend until the mast 120's resistance returns the ball to its default position. As may be understood, the systems 200, 400, and 500 may want to swing when the ball is hit. As shown in FIG. 8B, the tension system 230 may be wrapped around the handle 210 and the hooks attached to the fence under tension. As the ball is hit, the system's movement may be restricted by the opposing force of the bungee cord.

Figure 9:
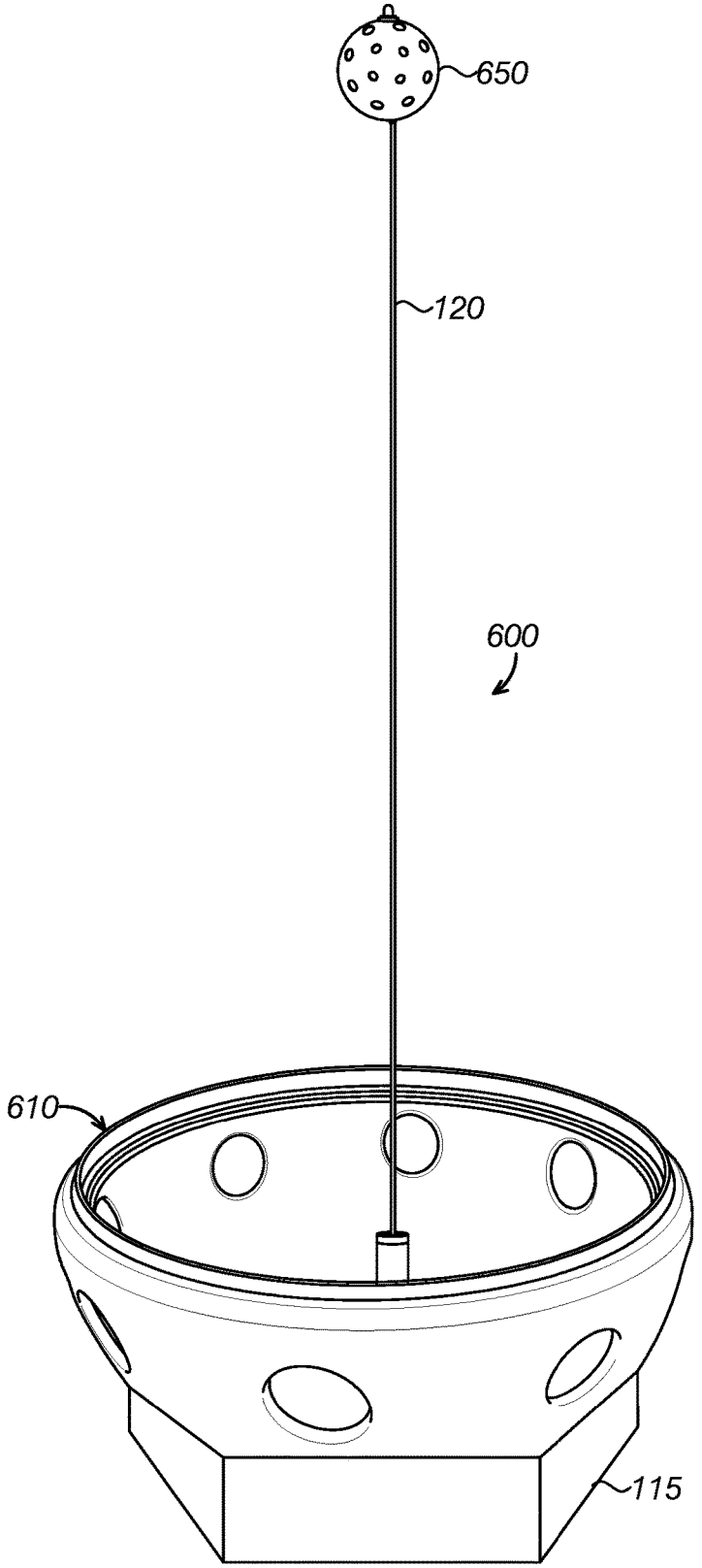
FIG. 9 is a front perspective view of a modular hitting training system in accordance with yet another exemplary embodiment.
Figure 10:
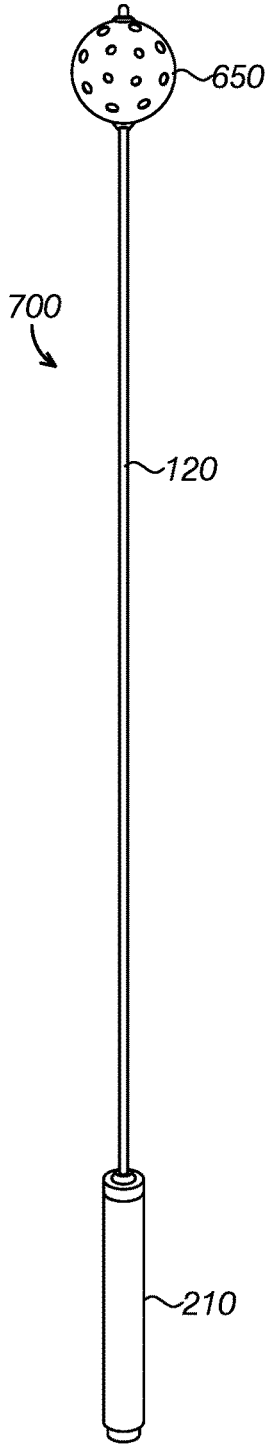
FIG. 10 is a front perspective view a handheld section of the modular hitting training system of FIG. 9 according to an embodiment.
Figure 11:
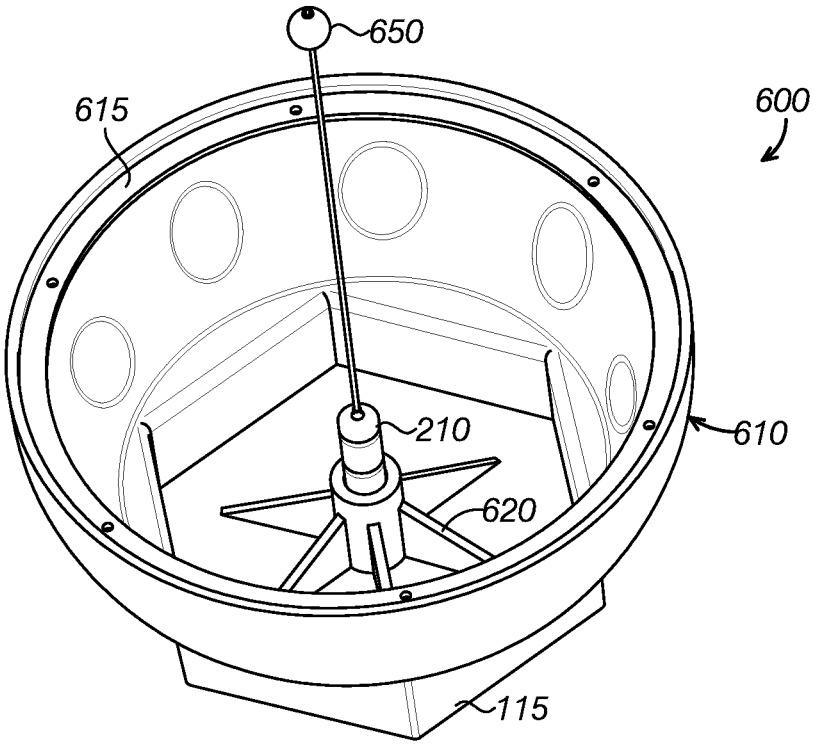
FIG. 11 is a top perspective view of the modular hitting training system of FIG. 9.
Figure 12:
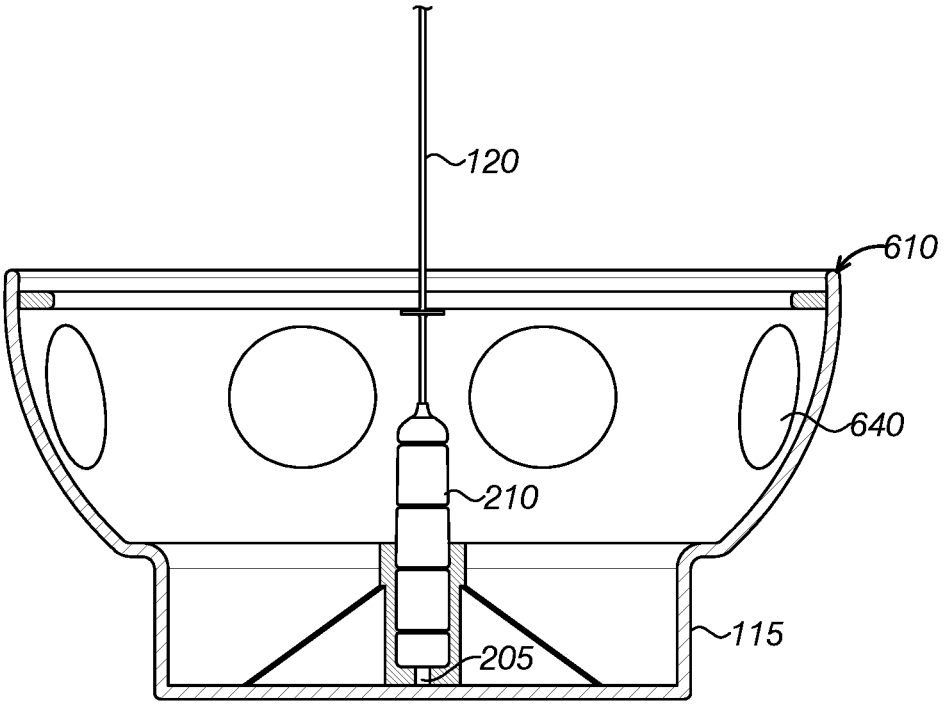
FIG. 12 is a cross-sectional, front partial view of the modular hitting training system of FIG. 9.
Figure 13:
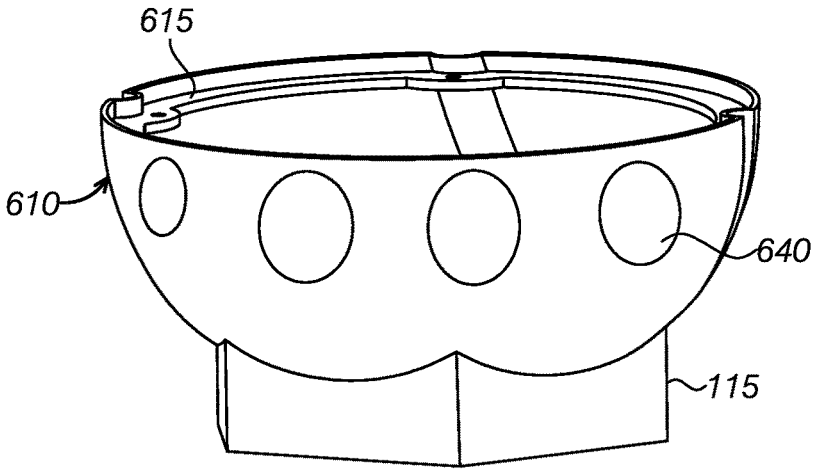
FIG. 13 is a side, partial perspective view of a basket of the modular hitting training system of FIG. 9.
Figure 14:
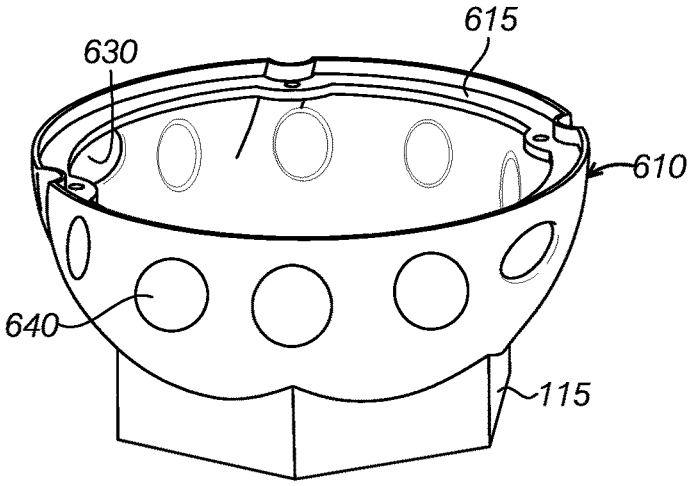
FIG. 14 is a top perspective view of the basket of FIG. 13.
Figure 15:
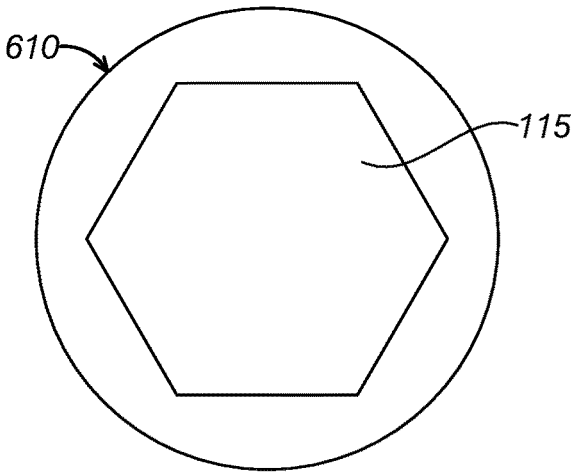
FIG. 15 is a bottom view of the basket of FIG. 14.

FIGS. 9-15, show a hitting training system according to another embodiments. As may be appreciated, some sports have light weight balls which traditionally are practiced or played with by hand. For example, some balls may be made of lightweight plastic material. A lightweight ball in this context is generally understood to be one ounce or less. For some activities, the balls may include just a shell with a hollow interior. The shell may be made even lighter by perforation, including a plurality of holes in the shell allowing air to travel through the shell. Sports including a pickle ball, wiffle ball, and many practice balls for other sports (including golf, baseball, softball, etc.) may use similar type balls with a variety of holes in the design that may be incorporated to prevent the ball from travelling far after being struck. FIG. 9 shows an exemplary embodiment of a hitting training system 600. The hitting training system 600 is similar to the hitting system 100 except that a lightweight ball 650 is mounted to the mast 120 coupled to the basket 610. The basket 610 may include a base 115 similar to the base 115 disclosed above. As an example, the lightweight ball 650 mounted is a pickle ball. While a pickle ball is shown, it will be understood that other types of lightweight balls may be mounted onto the mast 120.

Referring now to FIGS. 9-12, some embodiments of the hitting training system 600 may be modular. For example, the mast 120 may include a handle 210 (similar to the embodiments in FIGS. 7A-7D), except that the handle 210 may be modified for insertion into and detachment from a mount 620 in the basket 610. For example, the handle 210 may include a threaded female boss on its proximal end which may be screwed onto a threaded male boss 205 at the bottom of the mount 620 (See FIG. 12). When removed from the basket 610, the combination of the mast 120, handle 210, and lightweight ball 650 may be considered a distinct hitting training system 700 which may operate similar to the embodiments shown in FIGS. 7A-7D. The mast 210 may in some embodiments include a detachable mount system on its distal end (similar to, for example, the combination of mechanisms disclosed with respect to FIG. 2C for securing the ball to the end of the mast). The securing mechanism may be configured to include a seat or washer larger than the diameter of the pre-existing holes in the ball 650. As a result, the system 600 may use off-the shelf lightweight balls which already have perforations. Extra balls may be stored in the basket 610 when not in use on the end of the mast 120. The hitting training system 700 may measure approximately forty-four inches from the proximal end to the distal end (proximate the lightweight ball 650). As may be appreciated, aspects of the hitting training system 600 provide both the stability of the basket (for example, such as shown in FIG. 1) with the portability and convenience of hand-held training systems such as those shown in FIGS. 7A-7D.

Referring again to FIGS. 9-15, some aspects of the basket 610 may include elements for ease of portability. Some embodiments may include an opening in the basket wall defining a handle 630 from which one may carry or move the basket 610 between locations. In some embodiments, the basket 610 may include an interiorly projecting lip 615 coupled proximate an upper edge of the basket. The lip 615 may provide a detent to hold a cover (not shown) to prevent any balls within the basket 610 from falling out during transportation of the system 600. The cover may also be used to store balls 650 which may be detached from the mast 120.

Referring again to FIGS. 9-15, the basket 610 may be constructed with an exterior finish that resembles the lightweight ball 650 mounted to the system. For example, the wall defining the basket may include dimples 640 which from a distance may appear to be holes such as those found on a pickle ball. In some embodiments, the dimples 640 may be substituted with holes but as may be appreciated, the presence of holes may limit the number of balls carried within the basket 610.

While lightweight balls may not travel as far as traditional balls after being stuck, even lightweight balls with holes still travel and require the user to retrieve them, often from multiple locations because the struck balls do not travel along the same line after each swing. As may be appreciated, the embodiments show hitting systems which may eliminate the need to retrieve lightweight balls during training. When struck, the mast 120 may flex and return to its default position allowing the user to repeatedly practicing striking the ball without having to re-mount the ball to the system. As may be appreciated, one is not usually motivated to a lightweight ball because many activities that use a lightweight ball may not typically need to engage in repetitive swings because such balls are not usually used in competitive sports. However, pickle ball for example, is a competitive sports which will be aided by a mounted ball 650 that allows the user to repeat his or her swing without needing to retrieve the ball after being struck.

Many alterations and modifications may be made by those having ordinary skill in the art without departing from the spirit and scope of the invention. Therefore, it must be understood that the illustrated embodiments have been set forth only for the purposes of examples and that they should not be taken as limiting the invention as defined by the following claims. For example, notwithstanding the fact that the elements of a claim are set forth below in a certain combination, it must be expressly understood that the invention includes other combinations of fewer, more or different ones of the disclosed elements.

The words used in this specification to describe the invention and its various embodiments are to be understood not only in the sense of their commonly defined meanings, but to include by special definition in this specification the generic structure, material or acts of which they represent a single species.

The definitions of the words or elements of the following claims are, therefore, defined in this specification to not only include the combination of elements which are literally set forth. In this sense, it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptually equivalent, what can be obviously substituted and also what incorporates the essential idea of the invention.

Terms such as "top," "bottom," "front," "rear," "above," "below" and the like as used in this disclosure should be understood as referring to an arbitrary frame of reference, rather than to the ordinary gravitational frame of reference. Thus, a top surface, a bottom surface, a front surface, and a rear surface may extend upwardly, downwardly, diagonally, or horizontally in a gravitational frame of reference. Similarly, an item disposed above another item may be located above or below the other item along a vertical, horizontal or diagonal direction; and an item disposed below another item may be located below or above the other item along a vertical, horizontal or diagonal direction.

A phrase such as an "aspect" does not imply that such aspect is essential to the subject technology or that such aspect applies to all configurations of the subject technology. A disclosure relating to an aspect may apply to all configurations, or one or more configurations. An aspect may provide one or more examples. A phrase such as an aspect may refer to one or more aspects and vice versa. A phrase such as an "embodiment" does not imply that such embodiment is essential to the subject technology or that such embodiment applies to all configurations of the subject technology. A disclosure relating to an embodiment may apply to all embodiments, or one or more embodiments. An embodiment may provide one or more examples. A phrase such an embodiment may refer to one or more embodiments and vice versa. A phrase such as a "configuration" does not imply that such configuration is essential to the subject technology or that such configuration applies to all configurations of the subject technology. A disclosure relating to a configuration may apply to all configurations, or one or more configurations. A configuration may provide one or more examples. A phrase such a configuration may refer to one or more configurations and vice versa.

The word "exemplary" is used herein to mean "serving as an example or illustration." Any aspect or design described herein as "exemplary" is not necessarily to be construed as preferred or advantageous over other aspects or designs.

All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "step for." Furthermore, to the extent that the term "include," "have," or the like is used in the description or the claims, such term is intended to be inclusive in a manner similar to the term "comprise" as "comprise" is interpreted when employed as a transitional word in a claim.

What is claimed is:

1. A hitting training system for lightweight ball-based activities, comprising:

a base including six or more sidewalls, wherein the six or more sidewalls include at least 3 pairs of diametrically opposing sidewalls;

a flexible mast projecting upward from a central point of the base;

a seat on the mast configured to detain the ball, wherein the seat on the mast is in axial alignment with the central point of the base; and a ball weighing one ounce or less, affixed to an end of the mast, distal from the base, wherein:

hitting the ball from a default position of the mast bends the flexible mast, the mast is configured to return to the default position after the ball is hit, the ball includes a shell and a hollow interior, the shell includes a plurality of perforations, the mast passes through the hollow interior of the shell of the ball, the default position of the mast includes the distal end of the mast being in axial alignment with the central point of the base, the seat is positioned below the distal end of the mast, the distal end of the mast passes through the ball, and a cap secures the ball in place against the seat.

2. The system of claim 1, wherein the ball is a pickleball.

3. The system of claim 1, further comprising a basket coupled to the base, wherein the mast is coupled to the basket.

4. The system of claim 1, wherein the basket or base is weight filled.

5. The system of claim 1, further comprising a wire suspension system, wherein a proximal end of the mast is coupled to the wire suspension system.

6. The system of claim 1, further comprising a cover configured to attach to the basket, the cover including an opening positioned for the mast to pass through.

7. A hitting training system for lightweight ball-based activities, comprising:

a polygonal base, the polygonal base including six or more sidewalls, wherein the six or more sidewalls include at least 3 pairs of diametrically opposing sidewalls;

a basket positioned over the polygonal base, the basket configured for receipt of a plurality of hollow balls;

a wire suspension system coupled to the basket, the wire suspension system including a plurality of wires projecting inward from a periphery of the basket, wherein the plurality of wires meet at a central hub over a center of the basket;

a flexible mast projecting upward from a central point of the base and attachable to the central hub of the wire suspension system, the mast projecting upward from the central hub of the suspension system and from above the center of the basket;

a seat on the mast configured to detain the ball, wherein the seat on the mast is in axial alignment with the central point of the base; and a selected ball affixed to an end of the mast, distal from the basket, wherein:

hitting the selected ball from a default vertical position of the mast bends the flexible mast the mast is configured to return to the default vertical position after the selected ball is hit, the default position of the mast includes the distal end of the mast being in axial alignment with a central point of the base, the seat is positioned below the distal end of the mast, the distal end of the mast passes through the ball, and a cap secures the ball in place against the seat.

8. The system of claim 7, wherein the cap is removable and the selected ball is removable from the mast.

9. A hitting training system, comprising:

a base including six sidewalls, wherein the six sidewalls include at least three pairs of diametrically opposing sidewalls;

a flexible mast projecting upward from a central point of the base, wherein the mast is selectively removable from the base as a standalone device;

a ball affixed to an end of the mast, distal from the base, wherein hitting the ball from a default position of the mast bends the flexible mast and the mast is configured to return to the default position after the ball is hit;

a seat on the mast configured to detain the ball, wherein the seat on the mast is in axial alignment with the central point of the base; and wherein:

the default position of the mast includes the distal end of the mast being in axial alignment with the central point of the base, the seat is positioned below the distal end of the mast, the distal end of the mast passes through the ball, and the cap secures the ball in place against the seat.

* * * * *